US006487854B2

(12) United States Patent
Maus

(10) Patent No.: US 6,487,854 B2
(45) Date of Patent: Dec. 3, 2002

(54) EXHAUST GAS SYSTEM WITH AT LEAST ONE GUIDE SURFACE AND METHOD FOR APPLYING EXHAUST GAS FLOWS TO A HONEYCOMB BODY

(75) Inventor: Wolfgang Maus, Bergisch Gladbach (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/925,172

(22) Filed: Aug. 8, 2001

(65) Prior Publication Data

US 2002/0017097 A1 Feb. 14, 2002

Related U.S. Application Data

(63) Continuation of application No. PCT/EP00/00139, filed on Jan. 11, 2000.

(30) Foreign Application Priority Data

Feb. 8, 1999 (DE) ..... 199 05 032

(51) Int. Cl.[7] ..... F01N 7/00

(52) U.S. Cl. ..... 60/324; 60/302; 60/305; 60/323

(58) Field of Search ..... 60/323, 302, 299, 60/305, 324

(56) References Cited

U.S. PATENT DOCUMENTS

| | | | | | |
|---|---|---|---|---|---|
| 4,206,178 | A | | 6/1980 | Oya et al. | |
| 4,329,162 | A | * | 5/1982 | Pitcher, Jr. | 55/523 |
| 4,420,933 | A | * | 12/1983 | Kajitani et al. | 60/302 |
| 5,220,789 | A | * | 6/1993 | Riley et al. | 60/302 |
| 5,351,483 | A | * | 10/1994 | Riley et al. | 60/274 |
| 5,881,554 | A | * | 3/1999 | Novak et al. | 60/302 |
| 6,009,706 | A | * | 1/2000 | Haneda | 60/323 |
| 6,324,839 | B1 | * | 12/2001 | Canini et al. | 60/323 |

* cited by examiner

*Primary Examiner*—Thomas Denion
*Assistant Examiner*—Binh Tran
(74) *Attorney, Agent, or Firm*—Laurence A. Greenberg; Werner H. Stemer; Gregory L. Mayback

(57) ABSTRACT

An exhaust gas system includes a collector for joining exhaust gas flows from two or more cylinders of a combustion engine. The collector has an outlet cross-section behind which a tubular jacket is disposed. A honeycomb body is disposed in the tubular jacket. A space through which a flow is to take place is defined between the outlet cross-section and the honeycomb body. At least one guide surface is disposed in the space for diverting at least a part of the exhaust gas flows. A method is provided for applying exhaust gas flows to a honeycomb body. The flows arrive at the honeycomb body at least partly from different directions. The exhaust gas flows are diverted by at least a first guide surface, before they impinge upon the honeycomb body, in such a way that they flow in a direction at least partly opposite to that of the exhaust gas flows, and their incidence upon the honeycomb body is thus delayed.

20 Claims, 2 Drawing Sheets

EXHAUST GAS SYSTEM WITH AT LEAST ONE GUIDE SURFACE AND METHOD FOR APPLYING EXHAUST GAS FLOWS TO A HONEYCOMB BODY

CROSS-REFERENCE TO RELATED APPLICATION

This application is a continuation of copending International Application No. PCT/EP00/00139, filed Jan. 11, 2000, which designated the United States.

BACKGROUND OF THE INVENTION

FIELD OF THE INVENTION

The present invention relates to an exhaust gas system with a collector for joining exhaust gas flows from two or more cylinders of a combustion engine. The collector has an outlet cross-section behind which a tubular jacket is connected and a honeycomb body is disposed in the tubular jacket. The invention furthermore relates to a method for applying flows of exhaust gas to a honeycomb body.

Regulations require improvement in the cold starting behavior of combustion engines with respect to their exhaust gas emissions. For that purpose, it is known to provide a first catalytic converter close to the engine, for example closely behind a manifold. Due to the high temperatures behind the manifold, that leads to rapid heating up of the catalytic converter disposed behind it. However, that catalytic converter is also exposed to high degrees of thermal and mechanical shocks at that location, because of pulsating exhaust gas flows.

SUMMARY OF THE INVENTION

It is accordingly an object of the invention to provide an exhaust gas system with at least one guide surface and a method for applying exhaust gas flows to a honeycomb body, which overcome the hereinafore-mentioned disadvantages of the heretofore-known devices and methods of this general type and which improve an emission behavior of a combustion engine, in particular in a cold starting phase, and especially improve a useful life of a honeycomb body installed close to an engine.

With the foregoing and other objects in view there is provided, in accordance with the invention, an exhaust gas system, comprising a collector for joining exhaust gas flows from at least two cylinders of a combustion engine. The collector has an outlet cross-section. A tubular jacket is disposed downstream of the outlet cross-section in exhaust gas flow direction. A honeycomb body is disposed in the tubular jacket and defines a space between the outlet cross-section and the honeycomb body for conducting a flow. At least one first guide surface of the tubular jacket is disposed in the space for diverting at least a part of the exhaust gas flows.

Such a first guide surface delays the incidence of the individual exhaust gas flows upon the end surface of the honeycomb body facing the flow. Making the exhaust gas flows turbulent leads to an improved mixing of a total gas flow supplied to the honeycomb body which, in particular, improves the subsequent catalytic reaction. The measurement precision of a lambda probe for measuring oxygen content, which is optionally disposed in the collecting space or to the rear thereof, is increased, since the somewhat uneven composition of the individual exhaust gas flows is at least partially compensated for. As the flows of exhaust gas flow in the form of a pulsating flow into the collector, the first guide surface absorbs a pressure gradient and reduces it. The downstream honeycomb body is relieved to the extent of these pressure gradients. In this way, damage caused by the pulsating flow which could occur over a long period of operation, is advantageously avoided.

It is also advantageous to configure the first guide surface in such a way that the exhaust flows are diverted in front of the honeycomb body. Diversion, which means a substantial change to the original direction of the flow of exhaust gas flows, again delays their incidence upon the honeycomb body, so that in particular, interaction with the next pulse of exhaust gas from another exhaust gas pipe takes place in order to even out the pressure. In particular, a low pressure occurs in an advantageous manner after the pressure pulse, even in the other cylinders. Furthermore, because of the turbulence occurring in this way, it again makes it possible to obtain a good mixing of the fluid flows. A further development of the first guide surface is that it is configured in such a way that the flows of exhaust gas at least partially flow in reverse. This means that the exhaust gas flows are at least partially diverted back in the direction from which they have flowed. The first guide surface is preferably disposed in such a way that it is partly opposite the exhaust gas flows flowing into the chamber. A further development is that the first guide surface is disposed in such a way that direct flowing of the exhaust gas flows onto the honeycomb body is at least partially obstructed.

On one hand, this leads to limiting and preferably completely eliminating linear exposure of the end surface of the honeycomb body. With at least partial obstruction of the flow path, the pressure gradient is at least reduced to the point where possible damage to the honeycomb body occurring over a prolonged period of operation is prevented. Additionally, there are mixing effects between the individual exhaust gas flows. Chemical reactions, as well as homogenization of temperatures, can be obtained through the use of this mixing. Periodic differences in pressure in the individual exhaust gas flows can be compensated for in such a way that after turbulence of the flows has been obtained, a blended total exhaust gas flow impinges upon the end surface of the honeycomb body.

The first guide surface may use a guide plate for this purpose. The guide plate must be capable of absorbing temperature differences and pressure differences which occur. In particular, the first guide surface is configured in such a way that it reduces the free cross-section behind the outlet cross-section, to which in turn the free cross-section of the tubular jacket is joined. The first guide surface is therefore preferably constructed as a type of deflector.

Alternative and/or cumulative configurations of a first guide surface have regular or irregular holes distributed over part or all thereof, and/or notches on a lateral external edge, and/or at least one opening on an edge, and/or at least one arch or curvature on at least one of its surfaces.

An eddy space is preferably provided between the outlet cross section and the first guide surface, as a reaction space. There is sufficient space in the eddy space to ensure, for example, a mixing of the individual exhaust gas flows. Furthermore, this eddy space serves, in a certain way, as a steadying space for the entire exhaust gas flow finally impinging upon the end surface of the honeycomb body. Through the use of suitable dimensioning of the eddy space, the way in which mixing takes place, after eddying caused by the guide surface, can be adjusted. The layout of the eddy space also determines what pressure gradients of the individual exhaust gas flows act against one another, and can finally be homogenized. The eddy space also serves in the formation of an even temperature distribution within the entire exhaust gas flow finally impinging upon the honeycomb body.

Preferably, the first guide surface is disposed closer to the outlet cross-section than to the honeycomb body. For one thing, the guide surface absorbs a pressure gradient much earlier in this way. For another, in this way, a total flow resulting from different coinciding exhaust gas flows behind the guide surface is distributed over the subsequent free cross-section of the tubular jacket in such a way that the entire end surface of the honeycomb body receives the flow, homogenously over its cross-section.

In particular, the formation of rear turbulence behind the guide surface can be avoided, in combination with an appropriate layout of the flow surface. The same applies for the avoidance of areas in which a detached flow and thus an area exists, in which parts of the exhaust gas flow pause for a certain amount of time as compared to the rest of the flow. To the extent that one guide surface is insufficient for obtaining the advantages described, it is proposed to place a second guide surface between the first guide surface and the honeycomb body, in the space through which a flow is to take place.

The collector according to the invention is distinguished in that at least a first guide surface is a component of the collector. If it is, for example, a cast piece, the flow surfaces are cast together with the other parts of the collector in one operation.

The exhaust gas system honeycomb body according to the invention, which is disposed in a tubular jacket, is distinguished in that at least a first guide surface is a component of the tubular jacket. This can, for example, be done by suitable folding or the like during manufacture of the tubular jacket.

Alternative configurations provide that the guide surface for the exhaust gas system is disposed as a replaceable component between the collector and the tubular jacket. It is, for example, to be mounted as an insert in the collector or in the tubular jacket. The guide surface can also be an intermediate flange between the collector and the tubular jacket.

The proposed configuration of at least one guide surface on an edge of the flow path towards the honeycomb body therefore advantageously results in a central cross-section of the space through which a flow is to take place behind the guide surface being kept clear. However, at the same time it offers the inflow of the exhaust gas flows a corresponding opposite surface for producing turbulence.

With the objects of the invention in view, there is also provided a method for applying exhaust gas flows to a honeycomb body, which comprises providing a tubular jacket surrounding the honeycomb body and integrating at least one guide surface in the tubular jacket. The exhaust gas flows are directed at least partly from different directions into a given direction toward the honeycomb body. The exhaust gas flows are diverted with the at least one guide surface at least partly in a direction opposite to the given direction before impinging upon the honeycomb body, thus delaying impingement upon the honeycomb body.

The individual exhaust gas flows are diverted before reaching the honeycomb body in such a way that they flow at least partly in the direction counter to the exhaust gas flow, mix with one another, and only then are incident upon the honeycomb body. This method is particularly preferred when the flows of exhaust gas flow to the honeycomb body in a pressure pulsating manner. The method is also very advantageous when the individual exhaust gas flows flow to the honeycomb body time-offset with respect to one another.

In order to provide further improvement of the emission behavior of a combustion engine, in particular in the cold starting phase, it is proposed that the exhaust gas flows diverted and made turbulent through the use of the first guide surface flow through a second guide surface. In this way, in addition to the advantages described above, in particular the entire end surface of the honeycomb body is advantageously impinged by the flow even more homogenously over its cross-section.

Further advantages and features of the invention will be explained in more detail with reference to the following drawings, which provide additional, advantageous further developments when combined with one another and with the features described hereinabove. The drawings show a preferred area of application of the invention. In addition to the use of the exhaust gas system, the collector, the honeycomb body and the method in an exhaust gas installation of a combustion engine, the invention can also be used in particular where a plurality of individual fluid flows from different directions coincide with one another and directly thereafter impinge upon a honeycomb body with a catalytically active coating. Thus, particular advantages of the invention are obtained for fluid flows which, on one hand, have pressure gradients, are time-offset with respect to one another, in particular flow into one another and react chemically and/or have temperature gradients within the fluid flow or between fluid flows.

Other features which are considered as characteristic for the invention are set forth in the appended claims.

Although the invention is illustrated and described herein as embodied in an exhaust gas system with at least one guide surface and a method for applying exhaust gas flows to a honeycomb body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
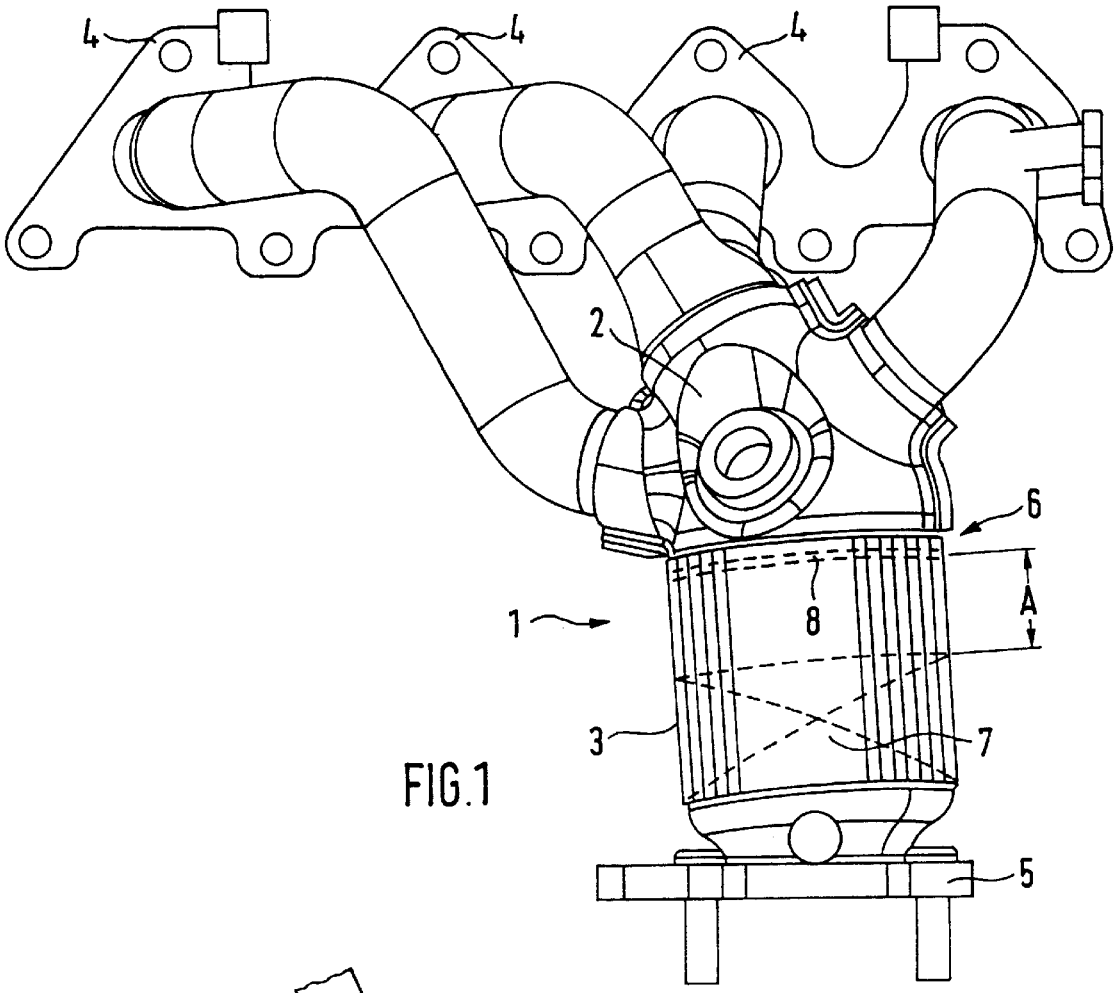
FIG. 1 is a diagrammatic, perspective view of an exhaust gas system with a collector and a honeycomb body connected directly thereto.

Referring now to the figures of the drawings in detail and first, particularly, to FIG. 1 thereof, there is seen a preferred area of application of an exhaust gas system 1 with a collector 2 for concentrating exhaust gas flows from two or more non-illustrated cylinders of a combustion engine, in particular from four exhaust gas flows of a four-cylinder engine. A tubular jacket 3 is disposed directly behind the collector 2. A honeycomb body 7 is disposed in the tubular jacket 3 as a starting catalytic converter. As is evident from the drawing, the exhaust gas system 1 is preferably constructed in such a way that first flanges 4 each lead to a respective individual cylinder of the combustion engine. A second flange 5 leads in a through-flow direction through the collector 2, behind the tubular jacket 3, to a connection, for example to an exhaust gas installation, leading towards an exhaust muffler. The exhaust gas system 1 forms a single component which can be built into the exhaust gas installation of the combustion engine. It is advantageous to provide the exhaust gas system 1 with a separating plane 6 so that the collector 2 and the tubular jacket 3 can be separated from one another again, for example for exchanging the starting catalytic converter.

Figure 2:
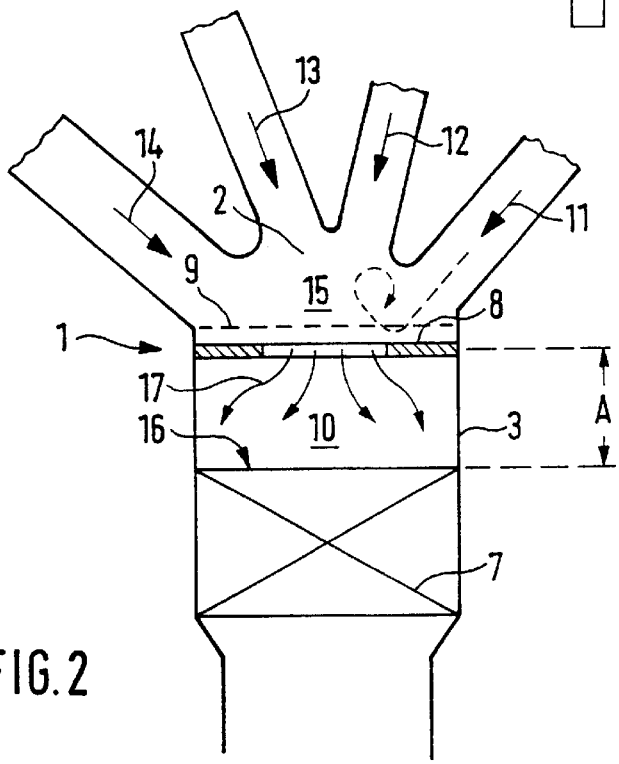
FIG. 2 is a fragmentary, partly sectional view of the exhaust gas system according to FIG. 1.

FIG. 2 shows a diagrammatic view of the exhaust system 1 of FIG. 1. Like elements have like reference numerals. A first guide surface 8 is disposed in a space 10 through which a flow is to take place, between the collector 2 and the honeycomb body 7 acting as a starting catalytic converter. A first exhaust gas flow 11, a second exhaust gas flow 12, a third exhaust gas flow 13 and a fourth exhaust gas flow 14, each indicated by an arrow, travel from the respective individual cylinders of the combustion engine through an outlet cross-section 9 of the collector, which is illustrated in broken lines in FIG. 2, and reach an eddy space 15. The individual exhaust gas flows 11, 12, 13, 14 can lead to a punctiform or patchy coverage of an end surface 16 of the honeycomb body 7. However, the first guide surface 8 is disposed in the space 10 through which a flow is to take place in such a way that the individual exhaust gas flows 11, 12, 13, 14 are at least partially made turbulent and diverted. For example, the first exhaust gas flow 11 partly strikes the first guide surface 8 and flows counter to the adjacent second exhaust gas flow 12. This leads to a mixing of those two exhaust gas flows 11, 12. This is particularly useful because of pressure pulsations in the exhaust gas system 1 due to active cylinder movements. The mixing of the exhaust gas flows 11, 12, 13, 14 can be optimized by suitable placement and configuration of the first guide surface 8 in the space 10 through which a flow is to take place. This is carried out, in particular, in such a way that an increased dwell time in the space 10 through which a flow is to take place is produced for a wide engine loading range. The result thereof is that because of the turbulence, for example, the first exhaust gas flow 11 on one hand, is mixed again within itself, but at the same time mixing with the adjacent second exhaust gas flow 12 is also produced. Due to this mixing, as yet incomplete reactions and conversions in the exhaust gas mixture are activated, temperature differences are balanced out and a homogenized volume flow flows towards the honeycomb body 7 as a resulting gas flow. It is therefore preferable that the first guide surface 8 be placed at a greater distance from the end surface 16 of the honeycomb body 7 than from the outlet cross-section 9 of the collector 2. A distance A between the end surface 16 of the honeycomb body 7 and the outlet cross-section 9 is selected in particular in such a way that a resultant total exhaust gas flow 17, shown as a multiple arrow fanning out, at least mainly flows onto the entire end surface 16 of the honeycomb body. Due to the mixing and because of the turbulence and the back-flowing of the individual exhaust gas flows 11, 12, 13, 14, locally increased thermally induced stressing of the honeycomb body 7 in the area of the end surface 16 is reduced, which in turn, with the conversion of the as yet unburned hydrocarbons which has to be completed, leads to homogenization of the temperature stressing of the honeycomb body 7.

Figure 3:
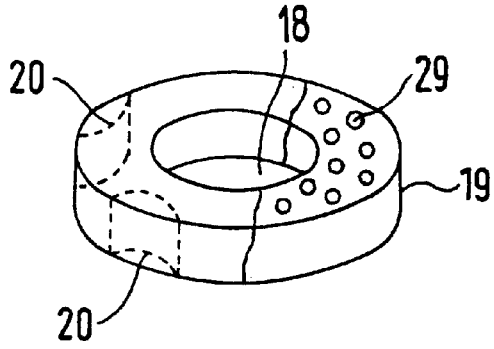
FIG. 3 is a perspective view of a first configuration of a guide surface in the form of a deflector.

FIG. 3 shows a first embodiment of a guide surface 8 which has the shape of an annular deflector. The deflector has an aperture 18 in its center through which the total exhaust gas flow flows in the direction of the honeycomb body after mixing. The guide surface 8, which is in the form of an annular deflector, has an external edge 19 that is connected flush with a tubular jacket of the honeycomb body, so in this case, through-flow of an exhaust gas flow is prevented. An alternative thereto provides for regularly and/or irregularly distributed cutouts 20, shown in broken lines in FIG. 3, which also permit through-flow along the external edge 19, and/or for the guide surface 8 to have partially or completely, regularly and/or irregularly distributed holes 29, through which the exhaust gas can flow, as shown on the right-hand side of FIG. 3. Moreover, a second such guide surface can be disposed between the first guide surface and the honeycomb body. The guide surfaces are offset one behind the other and have different flow cross-sections.

Figure 4:
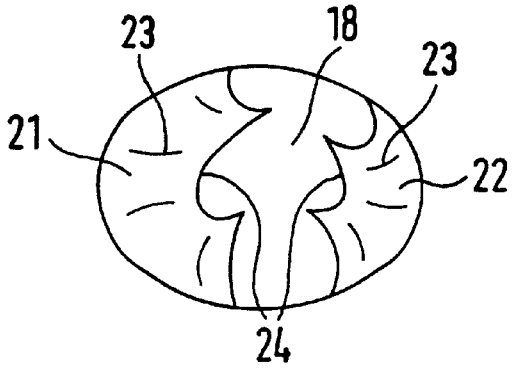
FIG. 4 is a plan view of a second embodiment of a guide surface, which is curved.

FIG. 4 shows a second embodiment of a guide surface 8. This guide surface has a first surface 21 and a second surface 22. The first and second surfaces 21, 22 are curved, and have an aperture 18 approximately in their center for through-flow. Arches, domes or curvatures 23 support the diversion of the exhaust gas flows striking the surfaces 21, 22. Furthermore, the two surfaces 21, 22 each have an edging 24 which is curved irregularly and differently. This configuration supports the mutual turbulence of the exhaust gas streams, which is not provided, for example, by having two such guide surfaces which are offset with respect to one another and disposed one behind another. The guide surface or surfaces are configured in such a way that, after flow-through the resultant total exhaust gas flow is distributed again, as far as possible without flow separation, over a total cross-section of the end surface of a subsequent honeycomb body through which a flow is to take place.

Figure 5:
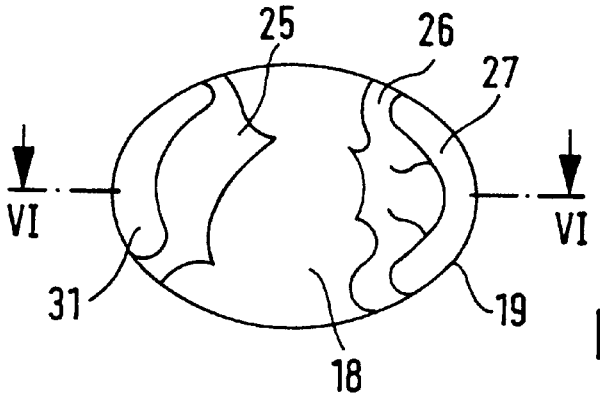
FIG. 5 is a plan view of a third embodiment of a guide surface, which is curved and has a cut-out on its edge.

FIG. 5 shows a third embodiment of a guide surface 8. This guide surface has a third surface 25 and a fourth surface 26. An aperture 27 is disposed between an external edge 19 and the respective third surface 25 or fourth surface 26, adjacent an approximately centrally disposed aperture 18. As a result thereof, no dead flow area exists behind the surfaces 25, 26. Instead, a flow through the edge aperture 27 leads to the formation of a low-pressure area along the sides of the surfaces 25, 26 facing towards the honeycomb body. As a result, the total exhaust gas flow is distributed by flowing through at least one or even two guide surfaces 8 according to FIG. 5.

Figure 6:
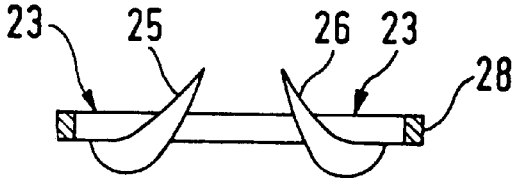
FIG. 6 is a cross-sectional view of a guide surface, which is taken along a line VI—VI of FIG. 5, in the direction of the arrows.

FIG. 6 shows the guide surface 8 according to FIG. 5 in a cross-section section taken along a line VI—VI. There is seen a ring of material 28, upon which the third surface 25 and the fourth surface 26 are attached. Furthermore, the respective arches or curvatures 23 of the two surfaces 25, 26 for diverting and reversing the flow of the exhaust gas flows striking them, are also shown.

It is noted that the guide surfaces 8 which are preferred according to the invention do not have to be configured in an annular manner as described. Guide surfaces configured in a partly-segmented manner can be used equally well and do not have to be mutually disposed on the same plane as adjacent guide surfaces. Rather, they can be offset from one another, as in the case of a configuration of several annular guide surfaces, each having a different construction.

I claim:

1. An exhaust gas system, comprising:

a collector for joining exhaust gas flows from at least two cylinders of a combustion engine, said collector having an outlet cross-section;

a tubular jacket downstream of said outlet cross-section in exhaust gas flow direction;

a honeycomb body disposed in said tubular jacket and defining a space between said outlet cross-section and said honeycomb body for conducting a flow; and at least one guide surface of said tubular jacket disposed in said space for diverting at least a part of the exhaust gas flows, said guide surface having holes evenly and unevenly distributed over at least part of said guide surface.

2. The exhaust gas system according to claim 1, wherein said guide surface at least partly obstructs a direct flow of the exhaust gas flows onto said honeycomb body.

3. The exhaust gas system according to claim 1, wherein said guide surface reduces a free cross-section downstream of said outlet cross-section flowing into a free cross-section of said tubular jacket.

4. The exhaust gas system according to claim 3, wherein said guide surface is a deflector.

5. The exhaust gas system according to claim 1, wherein said guide surface has holes evenly distributed over at least part of said guide surface.

6. The exhaust gas system according to claim 1, wherein said guide surface has holes unevenly distributed over at least part of said guide surface.

7. The exhaust gas system according to claim 1, wherein said guide surface has surfaces and at least one arched area on at least one of said surfaces.

8. The exhaust gas system according to claim 1, wherein said outlet cross-section and said guide surface define an eddy space therebetween.

9. The exhaust gas system according to claim 1, wherein said guide surface is disposed closer to said outlet cross-section than to said honeycomb body.

10. The exhaust gas system according to claim 1, wherein said guide surface is a first guide surface, and a second guide surface is disposed in said space between said first guide surface and said honeycomb body.

11. The exhaust gas system according to claim 1, wherein said first guide surface is integrated into said tubular jacket at a distance upstream of said honeycomb body in said exhaust gas flow direction.

12. The exhaust gas system according to claim 11, wherein said first guide surface is a deflector.

13. A method for applying exhaust gas flows to a honeycomb body, which comprises:

providing a tubular jacket surrounding the honeycomb body;

integrating at least one guide surface having holes evenly and unevenly distributed over at least part of the guide surface in the tubular jacket;

directing the exhaust gas flows at least partly from different directions into a given direction toward the honeycomb body; and diverting the exhaust gas flows with the at least one guide surface at least partly in a direction opposite to the given direction before impinging upon the honeycomb body, thus delaying impingement upon the honeycomb body.

14. The method according to claim 13, which further comprises directing the exhaust gas flows towards the honeycomb body with pulsating pressure, and calming the pulsating pressure by diversion.

15. The method according to claim 13, which further comprises directing the exhaust gas flows towards the honeycomb body with a mutual time offset.

16. The method according to claim 13, which further comprises directing the exhaust gas flows diverted by the guide surface through another guide surface.

17. An exhaust gas system, comprising:

a collector for joining exhaust gas flows from at least two cylinders of a combustion engine, said collector having an outlet cross-section;

a tubular jacket downstream of said outlet cross-section in exhaust gas flow direction;

a honeycomb body disposed in said tubular jacket and defining a space between said outlet cross-section and said honeycomb body for conducting a flow; and at least one guide surface of said tubular jacket disposed in said space for diverting at least a part of the exhaust gas flows, said guide surface having a lateral external edge with cutouts formed therein.

18. An exhaust gas system, comprising:

a collector for joining exhaust gas flows from at least two cylinders of a combustion engine, said collector having an outlet cross-section;

a tubular jacket downstream of said outlet cross-section in exhaust gas flow direction;

a honeycomb body disposed in said tubular jacket and defining a space between said outlet cross-section and said honeycomb body for conducting a flow; and at least one guide surface of said tubular jacket disposed in said space for diverting at least a part of the exhaust gas flows, said guide surface having an edge with at least one aperture formed therein.

19. A method for applying exhaust gas flows to a honeycomb body, which comprises:

providing a tubular jacket surrounding the honeycomb body;

integrating at least one guide surface, having a lateral external edge with cutouts formed therein, in the tubular jacket;

directing the exhaust gas flows at least partly from different directions into a given direction toward the honeycomb body; and diverting the exhaust gas flows with the at least one guide surface at least partly in a direction opposite to the given direction before impinging upon the honeycomb body, thus delaying impingement upon the honeycomb body.

20. A method for applying exhaust gas flows to a honeycomb body, which comprises;

providing a tubular jacket surrounding the honeycomb body;

integrating at least one guide surface, having an edge with at least one aperture formed therein, in the tubular jacket;

directing the exhaust gas flows at least partly from different directions into a given direction toward the honeycomb body; and diverting the exhaust gas flows with the at least one guide surface at least partly in a direction opposite to the given direction before impinging upon the honeycomb body, thus delaying impingement upon the honeycomb body.

* * * * *